US011551861B2

(12) United States Patent
Suzuki et al.

(10) Patent No.: US 11,551,861 B2
(45) Date of Patent: Jan. 10, 2023

(54) IGNITION COIL

(71) Applicant: Mitsubishi Electric Corporation, Tokyo (JP)

(72) Inventors: Daisuke Suzuki, Tokyo (JP); Chikara Hashida, Tokyo (JP); Shuji Yamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 105 days.

(21) Appl. No.: 17/253,669

(22) PCT Filed: Oct. 25, 2018

(86) PCT No.: PCT/JP2018/039586
§ 371 (c)(1),
(2) Date: Dec. 18, 2020

(87) PCT Pub. No.: WO2020/084724
PCT Pub. Date: Apr. 30, 2020

(65) Prior Publication Data

US 2021/0265107 A1 Aug. 26, 2021

(51) Int. Cl.
*H01F 38/12* (2006.01)
*F02P 3/02* (2006.01)

(52) U.S. Cl.
CPC ..... *H01F 38/12* (2013.01); *F02P 3/02* (2013.01)

(58) Field of Classification Search
CPC ..... H01F 38/12; H01F 2038/122; F02P 3/02
See application file for complete search history.

(56) References Cited

U.S. PATENT DOCUMENTS

2005/0134416 A1 6/2005 Mackawa et al.
2017/0309397 A1* 10/2017 Kawai ..... H01F 27/022

FOREIGN PATENT DOCUMENTS

JP 2005-183515 A 7/2005
JP 2015-201603 A 11/2015
JP 2016-051789 A 4/2016

OTHER PUBLICATIONS

International Search Report for PCT/JP2018/039586 dated Dec. 25, 2018 [PCT/ISA/210].
Written Opinion for PCT/JP2018/039586 dated Dec. 25, 2018 [PCT/ISA/237].
Notice of Reasons for Refusal dated Dec. 7, 2021 from the Japanese Patent Office in Japanese Application No. 2020-552442.

* cited by examiner

*Primary Examiner* — Jacob M Amick
(74) *Attorney, Agent, or Firm* — Sughrue Mion, PLLC; Richard C. Turner

(57) ABSTRACT

An ignition coil includes a primary coil, a secondary coil, a center core, a side core, a core cover, a case, and an insulating resin. The core cover is formed in a form that covers an inner side face, one thickness direction end face, and an other thickness direction end face of the side core. Wall portions that divide a mass of the insulating resin into portions, or reduce an amount thereof, are provided in the core cover on an aperture portion side of the case, which is the one thickness direction end face side of the side core.

10 Claims, 7 Drawing Sheets

IGNITION COIL

CROSS REFERENCE TO RELATED APPLICATIONS

This application is a National Stage of International Application No. PCT/JP2018/039586 filed Oct. 25, 2018.

TECHNICAL FIELD

The present application relates to an ignition coil.

BACKGROUND ART

In general, an ignition coil used in a vehicle-use internal combustion engine is such that a primary coil is disposed on an outer side of a central center core, a secondary coil is disposed on an outer side of the primary coil, and a side core is disposed on an outer side of the secondary coil, thereby configuring a transformer. Also, the side core is covered with a core cover. These parts are housed in a case, and connected to an internal part using a connector assembly that forms a connector for connection with a vehicle harness, after which the parts are fixed and insulated using an insulating resin. A switching ignitor is also connected to the connector assembly. Normally, an electromagnetic steel sheet is used for the center core and the side core, and a thermosetting resin such as an epoxy resin is used for the insulating resin. An output terminal is provided in the case, and is connected to an ignition plug of an internal combustion engine via a spring. The spring is housed in a protector, and an electrical leak between a plug hole and the spring is prevented by the protector.

Herein, the side core formed of an electromagnetic steel sheet exists inside an insulating resin with a different linear expansion coefficient, and distortion occurs in the insulating resin when thermal stress is applied. Further, when thermal stress is repeatedly applied, there is a possibility of cracking occurring in the insulating resin. Therefore, the core cover is mounted on the side core, thereby preventing cracking in the insulating resin originating in the side core. However, cracking in the insulating resin occurring due to the side core also affects a part opposing the side core. For example, there is a possibility of causing distortion of the secondary coil (of a bobbin in particular) to occur in a vicinity of the bobbin or the like of the secondary coil, which is disposed in a position near the side core and formed of a material that adheres well to the insulating resin. Cracking occurring as a result of this causes an internal leak, and distortion causes a coil disconnection, and there is a problem in that a decrease of an ignition device output voltage, or a phenomenon wherein output voltage is not generated, occurs.

Because of this, an ignition coil disclosed in, for example, Patent Literature 1 is such that a core cover of a side core is configured of two kinds of core cover, those being a first core cover of a material that adheres closely to an insulating resin and a second core cover of a material that peels away from the insulating resin, and cracking in the insulating resin is prevented by stress alleviation being achieved by causing a peeling away from the insulating resin in the second core cover.

CITATION LIST

Patent Literature

Patent Literature 1: JP-A-2005-183515

SUMMARY OF INVENTION

Technical Problem

In Patent Literature 1, cracking in the insulating resin is restricted by the second core cover peeling away from the insulating resin, but when the ignition coil increases in size owing to increased output of the ignition coil of the internal combustion engine, an amount of insulating resin in an upper portion of the side core also increases, and there is a problem in that stress due to expansion and contraction of the insulating resin in an engine heating and cooling cycle cannot be completely alleviated simply by the second core cover peeling away from the insulating resin. Also, two differing materials, those being the first core cover and the second core cover, are configured as one part by being integrally molded, or two differing materials are configured individually, because of which there is a problem in that processing costs and assembly man-hours increase, and the like.

Solution to Problem

The present application, having been contrived in order to resolve the heretofore described kinds of problem, has an object of providing an ignition coil that has durability and excellent reliability.

An ignition coil disclosed in the present application includes a primary coil, a secondary coil disposed concentrically on an outer periphery of the primary coil, a center core disposed on an inner periphery of the primary coil, a side core, disposed on an outer periphery of the secondary coil, that causes a magnetic flux of the center core to recur, a core cover that covers an inner side face, one thickness direction end face, and an other thickness direction end face of the side core, a case that houses the primary coil, the secondary coil, the center core, the side core, and the core cover, and an insulating resin that fills a gap inside the case, wherein wall portions that divide a mass of the insulating resin into portions, or reduce an amount thereof, are provided in the core cover on an aperture portion side of the case.

Advantageous Effects of Invention

According to the ignition coil disclosed in the present application, an ignition coil that has durability and excellent reliability can be obtained.

DESCRIPTION OF EMBODIMENTS

Figure 1:
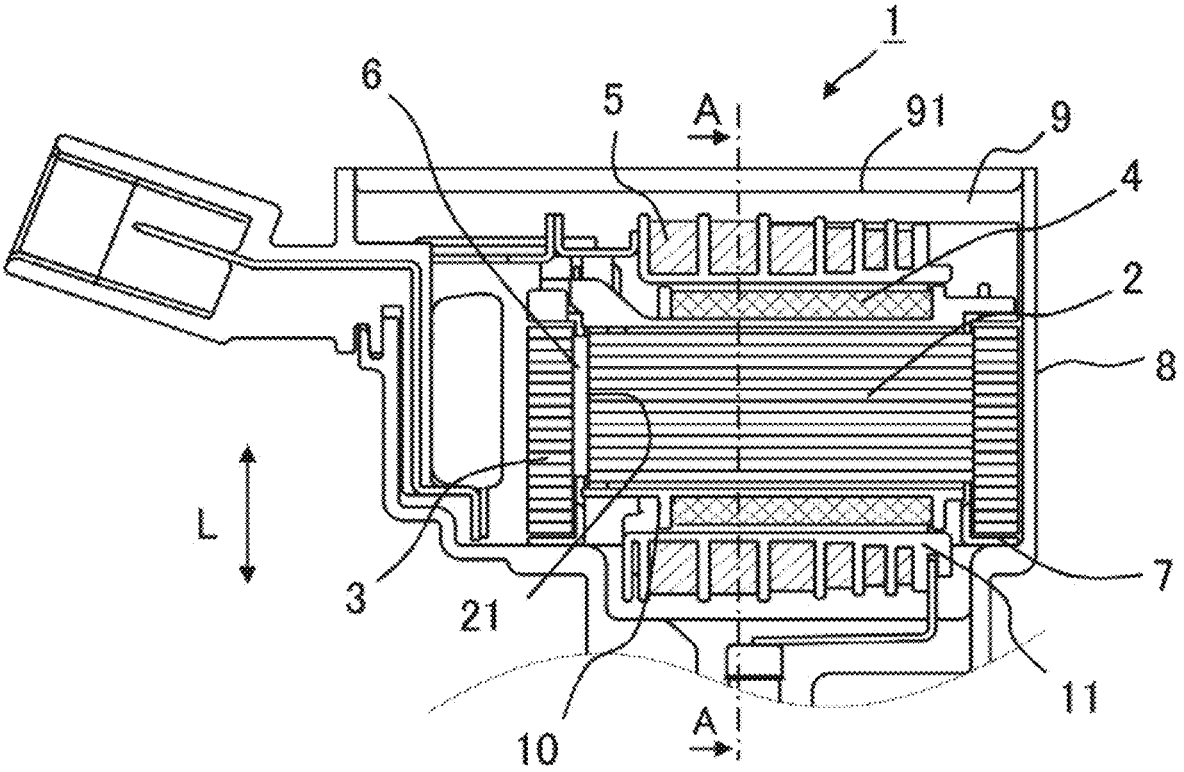
FIG. 1 is a sectional view showing a vehicle-use internal combustion engine ignition coil according to a first embodiment.

Hereafter, using the drawings, preferred embodiments of an ignition coil according to the present application will be described. In the following description, an ignition coil of a vehicle-use internal combustion engine will be described as an example of an ignition coil. However, the ignition coil according to the present application can be used not only in a vehicle-use internal combustion engine, but also in a vessel, an aircraft, or the like, used in an environment in which heat, a liquid, or the like exists. Identical reference signs in the drawings indicate identical or corresponding portions.

First Embodiment

Figure 2:
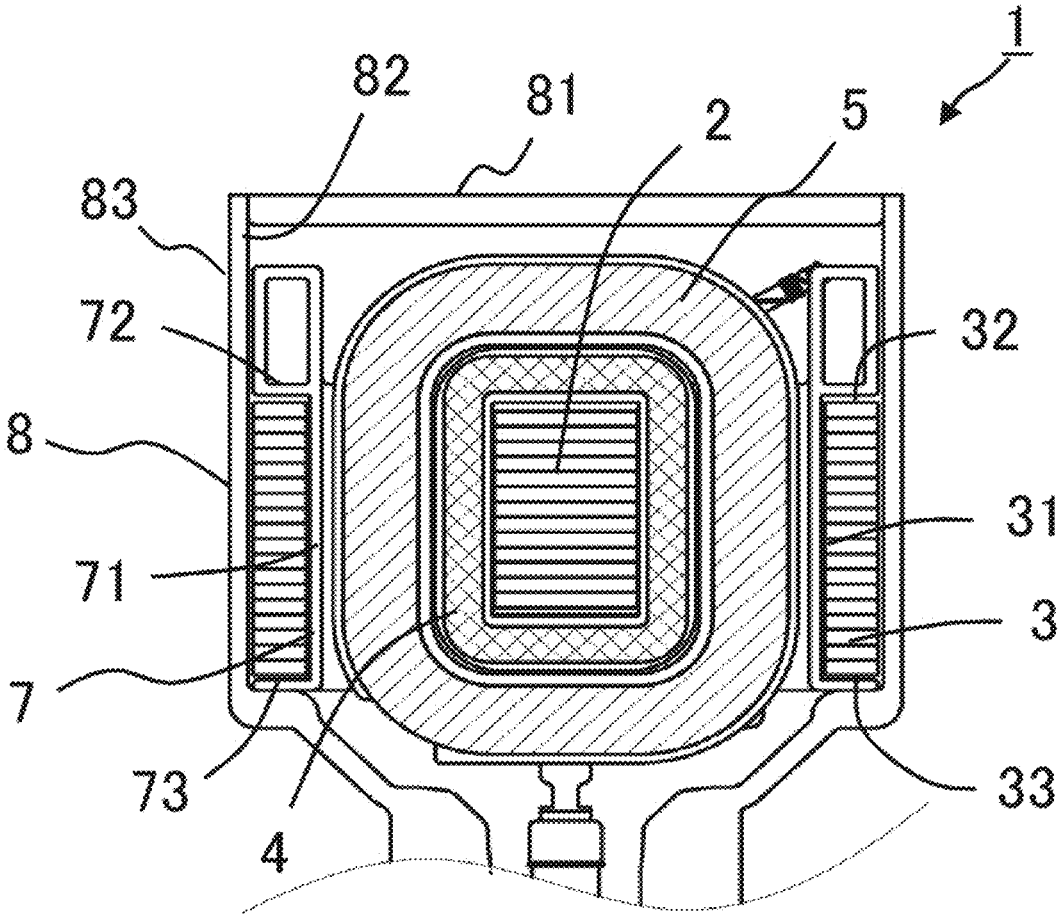
FIG. 2 is a sectional view along an A-A line of FIG. 1.

FIG. 1 is a sectional view showing a vehicle-use internal combustion engine ignition coil according to a first embodiment, and FIG. 2 is a sectional view along an A-A line of FIG. 1.

As shown in FIG. 1 and FIG. 2, a vehicle-use internal combustion engine ignition coil (hereafter simply called ignition coil) 1 is configured of a center core 2, a side core 3, a primary coil 4, a secondary coil 5, a magnet 6, and a core cover 7, and these are fixed and housed in an interior of a case 8 by the interior being filled with an insulating resin 9, which is a thermosetting epoxy resin. Also, the core cover 7 is configured of a material, a silicone resin for example, that easily peels away from the insulating resin 9.

The center core 2 is an approximately I-shaped core configured by electromagnetic steel sheets being stacked, the primary coil 4 is disposed on an outer periphery of the center core 2, and the secondary coil 5 is disposed concentrically on an outer periphery of the primary coil 4. The primary coil 4 and the secondary coil 5 are held by being wrapped respectively around a primary bobbin 10 and a secondary bobbin 11, which are fabricated from a resin material. The magnet 6, which is magnetized in a direction opposite to a direction of magnetic flux generated by energization of the primary coil 4, is brought into contact with one end face 21 of the center core 2. The annular side core 3, which forms a closed magnetic path together with the center core 2 and the magnet 6 and causes magnetic flux of the center core 2 to recur, is disposed on an outer periphery of the secondary coil 5.

The side core 3 is configured of two pairs of L-shaped side cores formed of stacked electromagnetic steel sheets. The core cover 7 is formed of one material in a horizontal U shape so as to cover an inner side face 31, one thickness direction L end face 32, and an other thickness direction L end face 33 of the side core 3. Also, an aperture portion 81 is formed in the case 8 on a side on which the one thickness direction L end face 32 of the side core 3 is positioned, and is configured in such a way that the primary coil 4, the secondary coil 5, the center core 2, the side core 3, and the core cover 7 can be housed from the aperture portion 81. The insulating resin 9 fills a gap inside the case 8.

The core cover 7 covers the inner side face 31, the one thickness direction L end face 32, and the other thickness direction L end face 33 of the side core 3, and alleviates stress occurring in the insulating resin 9 due to a difference in thermal expansion coefficient (linear expansion coefficient) between the insulating resin 9 and the side core 3. The core cover 7 has an inner side cover portion 71 opposing the inner side face 31 of the side core 3, a one end side cover portion 72 opposing the one thickness direction L end face 32 of the side core 3, and an other end side cover portion 73 opposing the other thickness direction L end face 33 of the side core 3. The one end side cover portion 72 and the other end side cover portion 73 are connected by the inner side cover portion 71, configuring a horizontal U shape.

Figure 3:
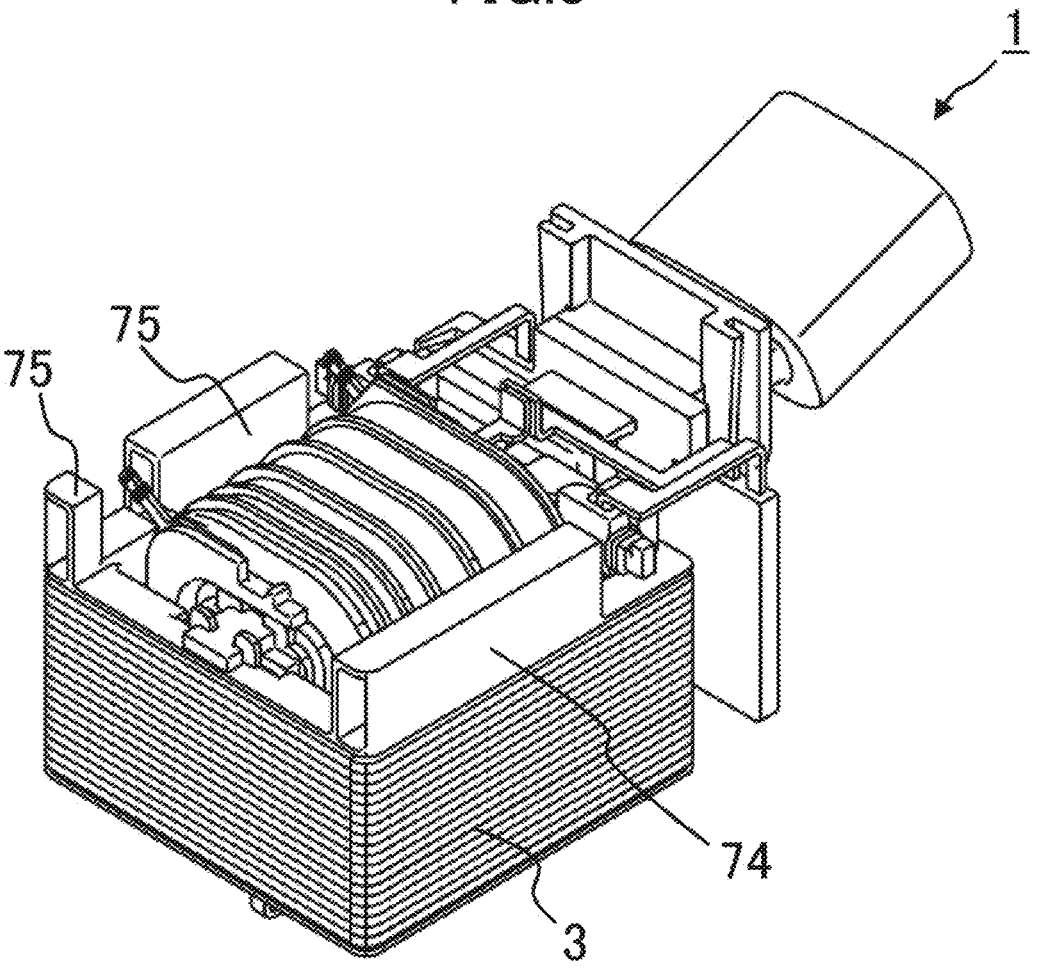
FIG. 3 is a perspective view illustrating a periphery of a side core and a core cover of the vehicle-use internal combustion engine ignition coil according to the first embodiment.

As shown in FIG. 3, wall portions 74 and 75 of the core cover 7 are formed protruding to the one thickness direction L end side from the one end side cover portion 72. By the wall portions 74 and 75 of the core cover 7 being as high toward the aperture portion 81 of the case 8 as permitted by an interface 91 (refer to FIG. 1) of the insulating resin 9, a mass of the insulating resin 9 above the one end face 32 of the side core 3 can be divided into portions, or an amount thereof can be reduced, whereby an amount of expansion and contraction of the insulating resin 9 caused by an engine heating and cooling cycle can be reduced.

Figure 4:
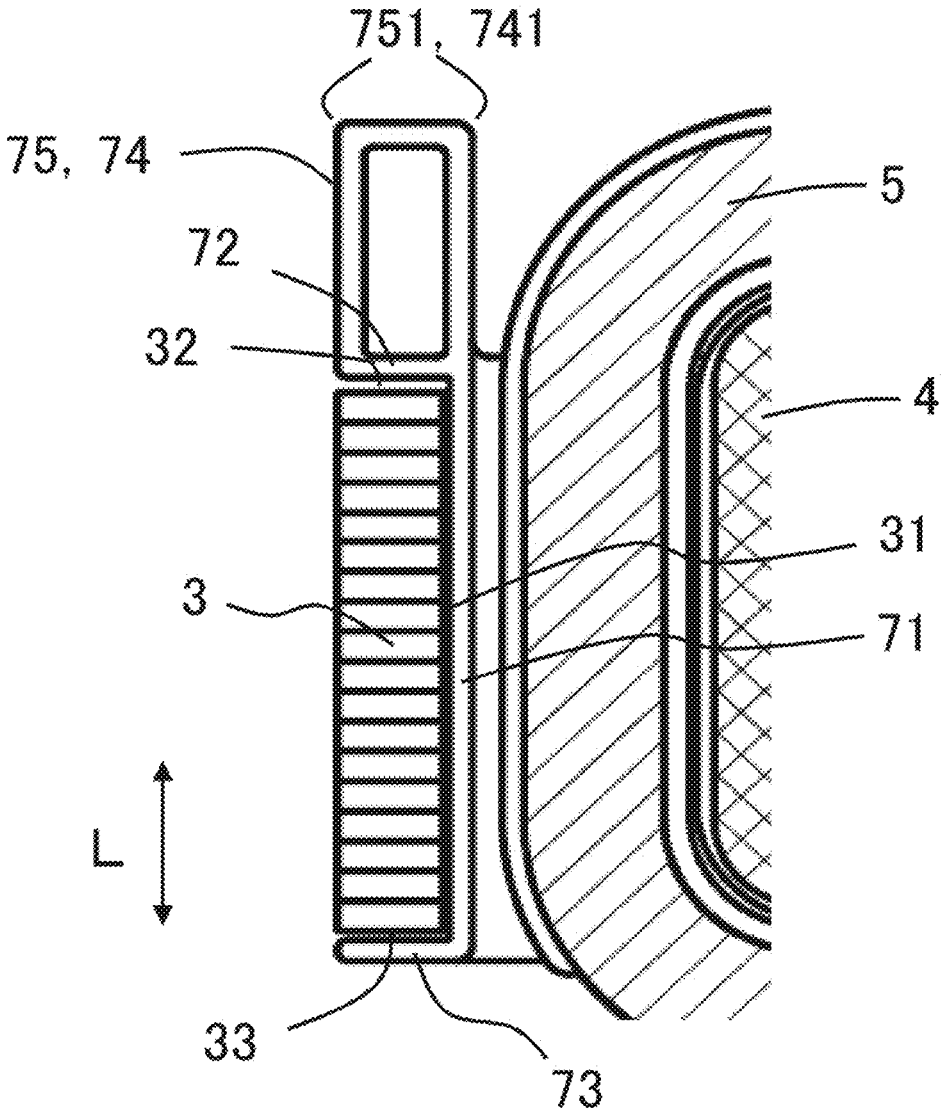
FIG. 4 is a partial sectional view illustrating the periphery of the side core and the core cover of the vehicle-use internal combustion engine ignition coil according to the first embodiment.

The core cover 7 is configured of a material that easily peels away from the insulating resin 9, and surfaces of the wall portions 74 and 75 are of a smooth form with no irregularity that peels away easily, as shown in FIG. 3 and FIG. 4. Also, curved portions are provided in corner portions 741 and 751 of the wall portions 74 and 75, and a whole surface of the core cover 7 is of a configuration that easily peels away from the insulating resin 9, while restricting cracking from the corner portions 741 and 751. An occurrence of peeling away or cracking can be regulated by curved portions of differing sizes being provided in opposing corner portions of the corner portions 741 and 751. A reason an occurrence of peeling away or cracking can be regulated by curved portions of differing sizes being provided in opposing corner portions is as follows.

Figure 5:
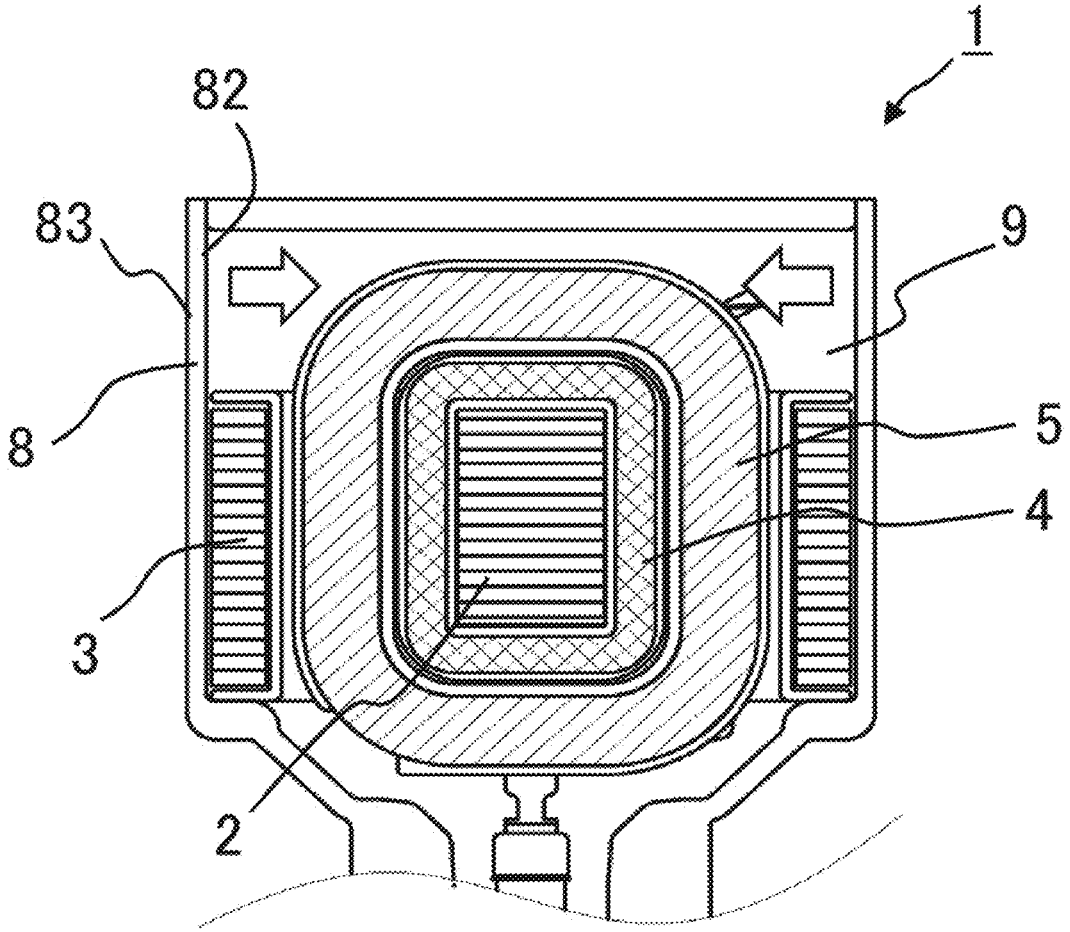
FIG. 5 is a drawing illustrating a direction of contraction of an insulating resin in an existing vehicle-use internal combustion engine ignition coil.

The corner portions 741 and 751 are places in which stress is liable to concentrate when thermal stress is repeatedly applied. That is, peeling away or cracking is liable to occur. The amount of the insulating resin 9 in a periphery of the corner portions 741 and 751 differs in accordance with a structure in a vicinity of the corner portions, and stress occurring in the corner portions due to repeated thermal stress also differs. For example, the corner portion 751 of FIG. 4 can be divided into a corner portion on the case 8 side (provisionally called a corner portion A) and a corner portion on the secondary coil 5 side (provisionally called a corner portion B). Although the insulating resin 9 contracts as indicated by white arrows in FIG. 5, the amount of the insulating resin 9 differs in accordance with the structure in a vicinity of the corner portions, and stress occurring varies between the corner portion A and the corner portion B. Because of this, there is a need to balance stress by reducing or increasing the size of one of the curved portions, thereby regulating an occurrence of peeling away or cracking.

The ignition coil 1 is such that when cooling during a heating and cooling cycle of the engine, the insulating resin 9 contracts. As the case 8 adheres to the insulating resin 9, the case 8 is also pulled in accordance with the contraction of the insulating resin 9. In an existing ignition coil, the insulating resin 9 attempts to contract toward a center of the ignition coil 1, as indicated by the white arrows in FIG. 5. Contraction of the case 8 adhering to the insulating resin 9 is stopped by the side core 3, which is disposed with a slight interval between the side core 3 and a side portion of an inner face 82 of the case 8. Because of this, tensile stress is applied to an outer face 83 of the case 8, and cracking occurs along an edge of the side core 3 in the outer face 83 of the case 8.

In response to this, the ignition coil 1 according to the first embodiment is such that the wall portions 74 and 75, which divide the mass of the insulating resin 9 into portions, or reduce the amount thereof, are provided in the core cover 7, whereby contraction of the insulating resin 9 is restricted, an effect of contraction of the insulating resin 9 decreases, and cracking of the case 8 can be restricted. Also, as the core cover 7 is formed of a material that easily peels away from the insulating resin 9, there is no longer a need to add a part for causing a peeling away from the insulating resin 9, meaning that the number of parts can be reduced, and assembly man-hours can be reduced.

Although the wall portions 74 and 75 are desirably in a whole periphery in a direction in which the side core 3 rotates in annular form, a configuration may be such that provision of the wall portions 74 and 75 is partially avoided, such as in a portion in which an end portion of the secondary coil 5 is wrapped around the primary bobbin 10, a so-called binding portion of the primary bobbin 10 and the secondary coil 5.

Also, an epoxy resin is often used as the insulating resin 9, but in this case, a polyamide (PA), polypropylene (PP), an elastomer, polyphenylene sulfide (PPS), silicone, or the like, which easily peels away from an epoxy resin, is desirably used as a material of the core cover 7.

Also, peeling away can also be effectively caused to occur by performing a surface coating with a peeling agent, or the like, on polybutylene terephthalate (PBT) or the like, with which adhesion to an epoxy resin is easily obtained, as a material of the core cover 7.

As heretofore described, the ignition coil 1 according to the first embodiment is such that the wall portions 74 and 75, which divide the mass of the insulating resin 9 into portions or reduce the amount thereof, are provided in the core cover 7, which is configured of one material, the mass of the insulating resin 9 above the side core 3 is divided into portions, or the amount thereof is reduced, by the wall portions 74 and 75, and an effect of expansion and contraction of the insulating resin 9 in a heating and cooling cycle of the internal combustion engine is reduced. Furthermore, the core cover 7 is formed of a material that peels away easily, stress is alleviated by the peeling away, and an occurrence of cracking in the insulating resin 9 is restricted. According to this kind of configuration, the ignition coil 1 that has durability and excellent reliability can be provided.

Second Embodiment

Figure 6:
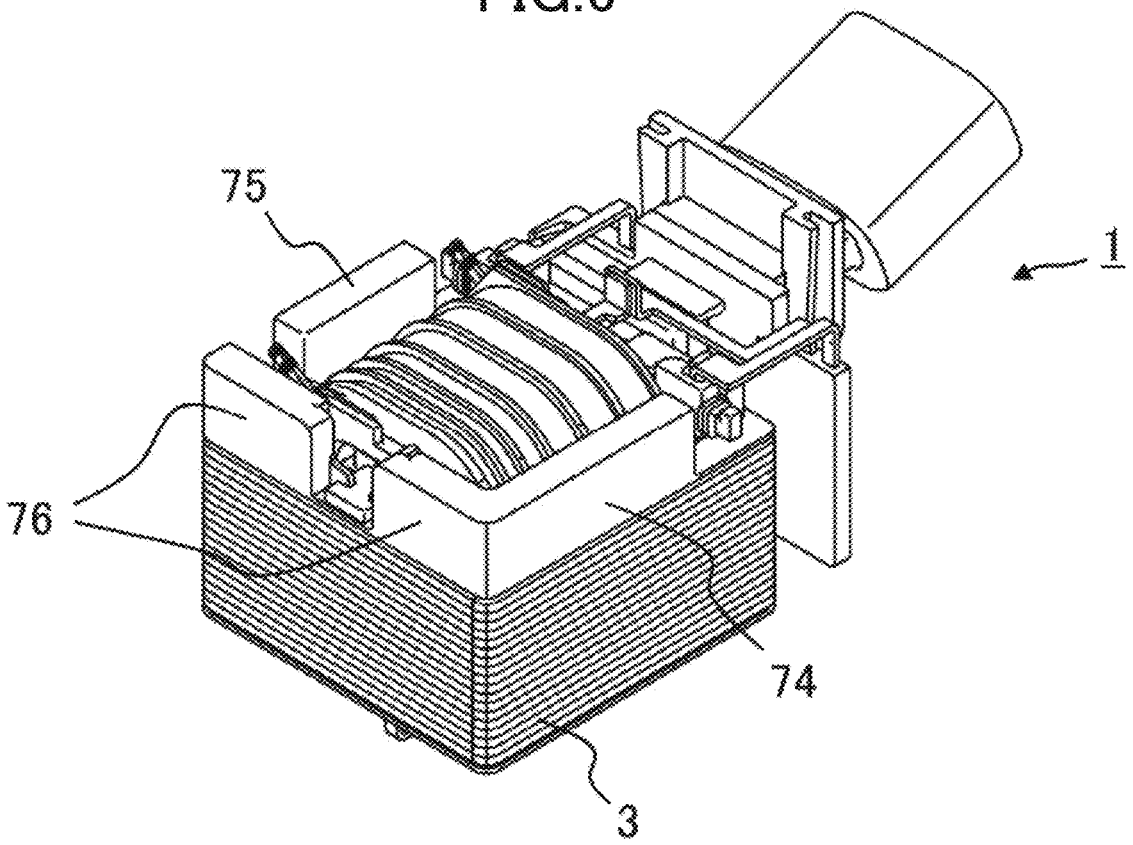
FIG. 6 is a perspective view illustrating a periphery of a side core and a core cover of a vehicle-use internal combustion engine ignition coil according to a second embodiment.
Figure 7:
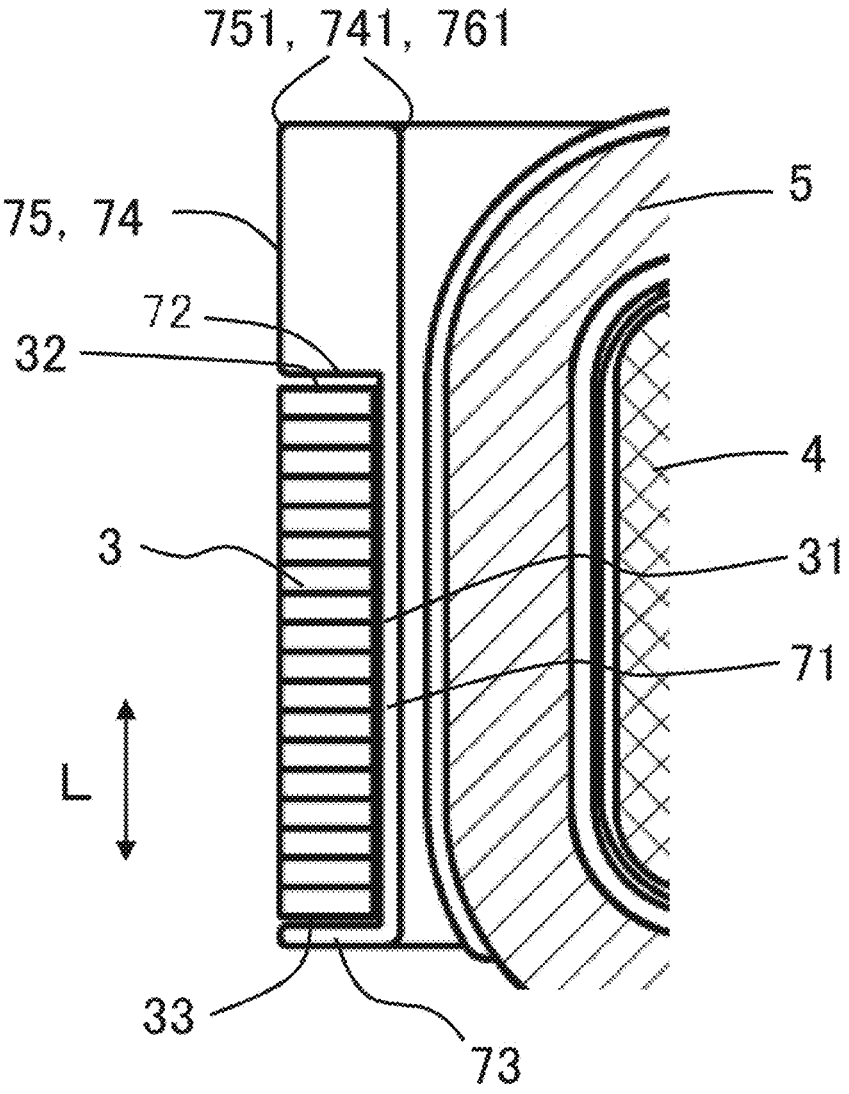
FIG. 7 is a partial sectional view illustrating the periphery of the side core and the core cover of the vehicle-use internal combustion engine ignition coil according to the second embodiment.

Next, an ignition coil according to a second embodiment will be described. FIG. 6 and FIG. 7 are drawings showing a periphery of a side core and a core cover of the ignition coil according to the second embodiment, wherein FIG. 6 is a perspective view, and FIG. 7 is a partial sectional view.

The wall portions 74 and 75 of the core cover 7 of the ignition coil 1 according to the first embodiment are formed in a horizontal U shape in consideration of sink marks after molding, and are of a hollow structure, but the wall portions of the core cover 7 may also be of a solid structure.

The core cover 7 of the ignition coil 1 according to the second embodiment is configured of a material that easily peels away from the insulating resin 9, in the same way as in the first embodiment, and the surfaces of the wall portions 74 and 75, and of a wall portion 76 that connects the wall portions 74 and 75, are of a smooth form with no irregularity that peels away easily, as shown in FIG. 6 and FIG. 7. Curved portions are provided in corner portions 741, 751, and 761 of the wall portions 74, 75, and 76, and a whole surface of the core cover 7 is of a configuration that peels away easily, while restricting cracking from the corner portions 741, 751, and 761. Also, as described in the first embodiment, an occurrence of peeling away or cracking can be regulated by curved portions of differing sizes being provided in opposing corner portions of the corner portions 741, 751, and 761. As other portions of the ignition coil 1 according to the second embodiment are the same as in the first embodiment, the same reference signs are allotted, and a description will be omitted.

By adopting a solid structure for the wall portions 74 and 75, there are advantages in that a configuration of a molding die structure for fabricating the wall portions 74 and 75 becomes simpler, the wall portion 76 connecting the wall portions 74 and 75 becomes easier to configure, the mass of the insulating resin 9 corresponding to a portion in which the wall portion 76 is positioned can be divided into portions, or the amount thereof can be reduced, and the amount of expansion and contraction of the insulating resin 9 can be reduced.

By providing the wall portions 74, 75, and 76, the amount of the mass of the insulating resin 9 can be reduced, because of which a decrease in height of the interface 91 caused by a curing contraction of the insulating resin 9 can be reduced. Because of this, a distance between an internal part of the ignition coil 1 and the interface 91 is more easily maintained, and an occurrence of cracking in the interface 91 can be restricted.

Also, in the first embodiment, the core cover 7 is formed in a horizontal U shape so as to cover the inner side face 31, the one thickness direction L end face 32, and the other thickness direction L end face 33 of the side core 3, but the core cover 7 may also be formed in such a way as to cover a whole periphery of the side core 3 using insert molding or the like. In this case, in order not to cause a gap to occur in a magnetic circuit, an open window form is adopted, without providing the core cover 7, in an interface of the center core 2 and the side core 3. By configuring in this way too, the same operational advantages as in the first embodiment can be obtained.

Although the present application is described in terms of various exemplifying embodiments and implementations, the various features, aspects, and functions described in one or a multiple of the embodiments are not limited in their applicability to a particular embodiment, but instead can be applied, alone or in various combinations, to other embodiments.

It is therefore understood that numerous modifications that have not been exemplified can be devised without departing from the scope of the present application. For example, at least one constituent component may be modified, added, or eliminated, and furthermore, at least one constituent component may be extracted and combined with the constituent components of another embodiment.

REFERENCE SIGNS LIST

1 ignition coil, 2 center core, 21 one center core end face, 3 side core, 31 side core inner face, 32 one side core thickness direction end face, 33 other side core thickness direction end face, 4 primary coil, 5 secondary coil, 6 magnet, 7 core cover, 71 inner cover portion, 72 one end side cover portion, 73 other end side cover portion, 74, 75, 76 wall portion, 741, 751, 761 corner portion, 8 case, 81 aperture portion, 82 inner face, 83 outer face, 9 insulating resin, 91 interface, 10 primary bobbin, 11 secondary bobbin, L thickness direction.

The invention claimed is:

1. An ignition coil, comprising:

a primary coil;

a secondary coil disposed concentrically on an outer periphery of the primary coil;

a center core disposed on an inner periphery of the primary coil;

a side core, disposed on an outer periphery of the secondary coil, that causes a magnetic flux of the center core to recur;

a core cover that covers an inner side face, one thickness direction end face, and an other thickness direction end face of the side core;

a case that houses the primary coil, the secondary coil, the center core, the side core, and the core cover; and an insulating resin that fills a gap inside the case, wherein wall portions are provided on an aperture portion side of the case in the core cover, the core cover being made of a material capable of peeling away from the insulating resin.

2. The ignition coil according to claim 1, wherein the wall portions are provided along an outer periphery of the side core.

3. The ignition coil according to claim 1, wherein the wall portions are formed in a hollow structure.

4. The ignition coil according to claim 2, wherein the wall portions are formed in a hollow structure.

5. The ignition coil according to claim 1, wherein the wall portions are formed in a solid structure.

6. The ignition coil according to claim 2, wherein the wall portions are formed in a solid structure.

7. The ignition coil according to claim 1, wherein surfaces of the wall portions are formed in a smooth form.

8. The ignition coil according to claim 2, wherein surfaces of the wall portions are formed in a smooth form.

9. The ignition coil according to claim 1, wherein curved portions of differing size are provided in opposing corner portions of the corner portions.

10. The ignition coil according to claim 2, wherein curved portions of differing size are provided in opposing corner portions of the corner portions.

* * * * *